US005901659A

United States Patent [19]

Vavolotis

[11] Patent Number: 5,901,659

[45] Date of Patent: May 11, 1999

[54] PIVOTALLY MOVABLE HIKING BENCH

[76] Inventor: Andrew C. Vavolotis, 3 Assawompsett Ct., Lakeville, Mass. 02347

[21] Appl. No.: 09/128,104

[22] Filed: Aug. 3, 1998

Related U.S. Application Data

[63] Continuation-in-part of application No. 08/730,749, Oct. 15, 1996, Pat. No. 5,787,837.

[51] Int. Cl.[6] ..... B63B 17/00

[52] U.S. Cl. ..... 114/363; 114/39.001

[58] Field of Search ..... 114/39.1, 61, 343, 114/363

[56] References Cited

U.S. PATENT DOCUMENTS

| | | | |
|---|---|---|---|
| 4,539,926 | 9/1985 | Boffer | 114/363 |
| 4,986,202 | 1/1991 | Mourgue et al. | 114/363 |

*Primary Examiner*—Ed L. Swinehart

*Attorney, Agent, or Firm*—Thomas L. Bohan

[57] ABSTRACT

A device designed to enable a sailor to move easily fore and aft and side-to-side about a watercraft. The device includes separate port and starboard bench units that are pivotally coupled to the watercraft and are movingly coupled to outboard rail systems extending fore and aft along the port and starboard gunwales of the watercraft. Additional rail systems incorporated into the bench units allow side-to-side movement. The bench units is designed and coupled to the rail systems and pivot points such that the sailor can remain on the bench unit and pivotally move it fore and aft, or slidingly move side-to-side by pushing his or her feet on the underlying substrate above which the sailor sits. The bench unit is preferably designed to permit the sailor to straddle it. The seat portions of the bench units are extendable beyond the outer edge of the watercraft. A handrail affixed to the bench enhances stability for the sailor. An optional braking system that can be engaged or disengaged by the sailor prevents undesired movement of the bench unit fore and aft along the outboard rails.

32 Claims, 7 Drawing Sheets

16
15
36
14
31

31
130
39
39
37
33
32
33
51
52
53
35
131

PIVOTALLY MOVABLE HIKING BENCH

CROSS REFERENCE TO RELATED PATENT APPLICATION

This application is a continuation-in-part of the Andrew C. Vavolotis U.S. patent application Ser. No. 08/730,749 filed Oct. 15, 1996, now U.S. Pat. No. 5,787,837 for MOVABLE HIKING BENCH and the contents of that related patent are incorporated herein by reference.

BACKGROUND OF THE INVENTION

1. Field of the Invention

The present invention is related to devices for moving around watercraft. More particularly, the present invention is related to benches or seats affixable to watercraft and designed to make movement around the watercraft easier. Still more particularly, the present invention is related to hiking benches or seats affixable to sailing watercraft, including mono- and multi-hull watercraft. Most particularly, the present invention relates to hiking benches or seats pivotally affixed to the hull of a sailing watercraft.

2. Description of the Prior Art

Sailing has been, and continues to be, a recreational and commercial endeavor of great interest throughout the world. It is, however, a significant undertaking, requiring considerable concentration and physical exertion in order to properly control the craft. This is particularly so when the sailing vessel is operated by a lone individual. The strain of concentration and physical effort can be exhausting, either lessening the pleasure of sailing, reducing the amount of time spent sailing, or a combination of the two.

The strain associated with sailing can be even greater in multi-hull craft—e.g., catamarans and trimarans, craft commonly designed with two or more separate hull sections linked together by a very lightweight support component. The support component is usually a pair of braces or cross-beams that join the hulls together in such craft. Larger multi-hull craft may employ more than two braces to join the hulls. In most salcraft of this type, a soft, flexible material of the type generally used in making trampolines is stretched across the area between the braces and the hulls. Hence this portion of the multi-hull craft is referred to as the 'trampoline.' This material has considerable "give," and is difficult to move about on. Unfortunately, this trampoline between the hulls makes movement about the vessel a time consuming and physically difficult task. Moreover, when the craft is moving at high speeds, the lack of surefootedness associated with the trampoline material renders operation of the craft somewhat hazardous.

Another disadvantage associated with the trampoline is the required positioning of the sailor on the trampoline. The sailor must sit with his or her feet outstretched, making it awkward and difficult to move from one position to another. Not only is this an awkward position to be in for an extended period of time, it also subjects the sailor to sitting on a surface that is, for the most part, wet. A further disadvantage with the trampoline is that it is an energy-absorptive material. That is, when the sailor moves on the craft port and starboard and fore and aft in order to trim it, part of the trimming comes from the transfer of the sailor's weight to the structural components of the craft. The absorptive characteristic of the trampoline reduces and/or delays that weight transfer, thereby causing a delay in the trimming of the craft, or at least a reduction in the effectiveness of the weight transfer.

Several devices have been made available to ease the effort required to move about multi-hull and/or high speed, small-hull craft. Specifically, trapezes have been attached to such craft. The trapeze is affixed to the upper section of the mast and is designed to permit the sailor seated on it to swing out beyond the port and starboard limits of the craft in order to increase the righting moment in higher winds. However, it is also a relatively dangerous procedure, particularly at high speeds, where a pitching of the boat may cause the sailor to lose the capability to right the craft. As speed increases, it becomes necessary to move further aft to trim the sailcraft. The ability to hike out on a trapeze further aft, however, is limited. Sudden deceleration caused by "stuffing" the bow of the craft in an oncoming wave, poses an additional problem for a sailor using a trapeze to trim the craft. When such deceleration occurs, momentum drives the person on the trapeze toward the bow, exposing him or her to injury, and bringing the craft out of trim. In addition, considerable physical strength and expertise is required in order to successfully operate the trapeze. This need for such skill is of particular importance when the sailor seeks to come about. In that situation, the sailor must come off the trapeze, disconnect it from the side of the craft it is connected to, walk across the trampoline, and re-connect it so as to get outboard on the other side. It is well known to those skilled in this field that coming about is an important procedure. The process described for re-configuring the trapeze is relatively time consuming and does require movement across the trampoline—an unsteady endeavor, particularly at high speeds, in gusty winds, and in rough seas. As a result, the trapeze is a less-than-optimum means for trimming the craft, both fore and aft and port and starboard. It is also a difficult task, again, particularly at high speeds. Thus, except for the most expertly skilled and most physically fit, most sailors are unlikely to find the trapeze's benefits outweigh its deficiencies.

An alternative device that is available and that may be used for multi-hull craft but that is specifically designed for small craft is a stationary rack that extends out beyond the port and starboard sides of the craft. The rack is designed somewhat like an outrigger in that it extends outboard; however, it also includes a seat on which the sailor sits. Unfortunately, the device is fixed in place and therefore does not aid the sailor in moving fore and aft to level the craft and, therefore, it has limited applicability in sailing.

Other devices have been described for the purpose of making movement about a watercraft easier. Although these devices have not been specifically directed to sailing craft, they do, however, provide an indication of the need for less hazardous and less physically tiring means for moving about and controlling a vessel. Gibson (U.S. Pat. No. 3,718,365, issued 1973) describes a slidable seat that can be moved on rails running port and starboard on a boat. The rails are designed to be fixed in place, although they can be adjusted to different positions on the gunwales of the boat. This device fails to address the needs associated with the piloting of a sailing craft, where relatively rapid movement around the entire craft—including fore and aft—is important. Since the rails are essentially fixed in place, it is not possible to quickly move the Gibson device fore and aft. Johnson (U.S. Pat. No. 4,766,838, issued 1988) and Andrews (U.S. Pat. No. 4,709,648, issued 1986), teach similar types of sliding seats. As with the Gibson device, these sliding seats fail to provide easy movement in the fore and aft directions.

Ross (U.S. Pat. No. 5,377,607, issued 1994) describes a sailboard with components that permit the board to be converted between sailing, paddling, and rowing types. The craft includes a movable multi-function seat. A limitation of the Ross craft that is critical to the discussion of the present invention as it relates to multi-hull and high-speed mono-hull craft is the board itself The Ross board is, effectively, a wide mono-hull having add-on components that cannot be applied to multi-hull and high speed craft. These components are necessary for the Ross design in order to permit conversion from one type of craft to another. Further, when the Ross device is set up as a sailing craft, the bench seat is apparently fixed in place by pins so as to prevent movement of the seat, either port and starboard or fore and aft.

The outrigger seat of Boffer (U.S. Pat. No. 4,539,926, issued 1985) is pivotally fastened to the mast of a sailboard body and includes cable pulls and foot controls connected to the craft's rudder. This design assumes that the center of gravity, center of buoyancy, and point-of-effort of the sail-craft lie at or close to the point where the mast is attached to the body of the boat. In fact, the centers of gravity and buoyancy and point-of-effort in many sailcraft lie well aft of the mast, shifting with changes in wind, craft speed, and sail trim. It is at this point that a sailor can best exert control over the trim of the vessel by hiking out. The seat of Boffer, by being attached to the mast of the sail craft, places the maximum hike-out position too far ahead of the vessel's actual centers of gravity and buoyancy and point-of-effort, thereby reducing the operator's ability to effectively control the trim of the craft. Moreover, the mast may experience a considerable amount of stress at its base due to the presence of the outrigger seat of Boffer. The combination of the forces exerted on the mast by both the wind and the operator may cause irreparable damage to the mast. Furthermore, the device of Boffer is designed primarily for small single-person sailcraft, and is not adaptable to vessels that are either multi-hulled or can accommodate more than one person.

The device of the present inventor, described in pending U.S. patent application 08/730,749, solves these problems by providing a hiking bench system that enables a sailor to safely and quickly hike out on a sailing craft. In particular, the device facilitates the hiking out maneuver on multi-hulled craft by means of a bench coupled to a rail by means of a roller system that permits the sailor to move from side-to-side and fore-and-aft without having walk across the trampoline section of the craft. The hiking bench is extendable beyond the width or beam of the boat to allow the sailor to better trim the craft. A rail system for tri-hulled craft is also described in which two separate rail systems are affixed to the center hull and extend outward from it, thereby allowing free movement along the center hull of the craft. Because the device employs rollers and a pair of rails to accomplish movement fore and aft, however, the degree of movement in these directions is limited by the length of the rails. Because the rail system may span the width of the craft, obstructions, such as a mast or rigging, at or near the center of the craft limit the length of travel of the bench system fore and aft. In addition, it is advantageous to minimize the weight of any hiking device in order to maximize sailing speed.

In summary, there does not presently exist a simplified, lightweight system for aiding in the safe, complete, and efficient movement of a sailor about a sailing craft. Therefore, what is needed is a safe, lightweight, and efficient device designed to permit a sailor a wider range of movement both fore and aft as well as port and starboard on a sailing craft. What is needed is a device that permits more rapid and easier hiking in and out on the craft than that achievable by moving on a trampoline alone. What is also needed is a hiking device that couples the sailor's weight directly to the structural components of the craft, rather than coupling that weight through the energy-absorbing trampoline and without posing the threat of damage to major components of the craft. What is also needed is a hiking device that capable of pivoting about a central point. What is further needed is a hiking device that can be affixed to a point on the vessel that is located near the center of gravity, center of buoyancy, and point-of-effort, in order to optimize the effect of hiking out on control of the craft. What is further needed is a pivotally movable hiking device that can be mounted at a position anywhere along the center line of the vessel. What is also needed is that such a pivotally mounted hiking device be easy to install and maintain. Further, what is needed is such a device that provides a comfortable position for the sailor, in contrast to the uncomfortable, and usually wet, position associated with sitting on a trampoline. What is also needed is such a device that is adaptable to mono-hull and multi-hull craft. Yet further, what is needed is a device that includes a direct and secure coupling of the sailor to the craft, particularly in high winds and/or rough seas.

SUMMARY OF THE INVENTION

It is an object of the present invention to provide a simple, safe, lightweight, and efficient device that is designed to permit a wide range of movement by a sailor fore and aft as well as port and starboard on a sailing craft. It is another object of the present invention to provide a pivotally movable device that permits rapid and easy hiking in and out on the craft than is achievable by moving on a trampoline alone. It is still another object to provide a hiking device that couples the sailor's weight directly to the structural components of the craft, rather than coupling that weight through the energy-absorbing trampoline. It is yet another object of the present invention to provide a device that provides a comfortable position while sailing, rather than the uncomfortable, and usually wet, position associated with sitting on a trampoline. It is also an object of the present invention to provide a hiking device that is capable of pivoting about a central point. It is yet another object of the present invention to provide a hiking device that can be affixed to a point on the vessel that is located near the center of gravity, center of buoyancy, and point-of-effort, in order to optimize the effect of hiking out on control of the craft. It is a further object of the present invention to provide a pivotally movable hiking device that can be mounted at a position anywhere along the center line of the vessel. It is also object of the present invention to provide a pivotally mounted hiking device that is easy to install and maintain. Further, it is an object to provide such a device that is adaptable to mono-hull and multi-hull craft. Yet further, it is an object of the present invention to provide such a device that includes a direct and secure coupling of the sailor to the craft, particularly in high winds and/or rough seas.

These and other objectives are achieved in the present invention by a movable hiking bench system that combines a pivot point, a chassis, and an outboard rail system to which the hiking bench is coupled. The overall hiking bench system consists of a pair of hiking bench units—one for the port side and one for the starboard side of the craft. Each hiking bench unit consists of a hiking bench that slidably moves along a chassis that is pivotally attached to the central hull section of the sailcraft and by rolling means to outboard rails located at the outer edges or gunwales of the craft. Each hiking bench unit is designed to span substantially one half of the complete width or beam of the craft. That is, the port hiking bench unit extends effectively from the center pivot point of the port bench to the left (port) side of the watercraft and the right (starboard) hiking bench extends effectively from the center pivot point of the starboard bench the right (starboard) of the watercraft. Both hiking benches may be extendable beyond the side of the craft in order to increase the sailor's ability to trim the craft.

The chassis of each hiking bench unit is attached to a pivot point on the center hull section of the craft. The port and starboard hiking bench units may share a common pivot point. However, fixing the two units at separate points on the center hull section of the craft may be desirable, as it would permit crew members to move along the center hull section of the craft more easily. Either hiking bench may extend less than the full width of the craft; however, that would reduce the effective range of movement available to the sailor to trim the craft.

In addition to attaching to the central hull section of the craft, the chassis of each hiking bench is also attached by roller means to fixed outboard rails running along the outermost portion of the gunwale on either side of the craft. This provides the sailor with a complete range of motion fore and aft of the craft. Each of he outboard rails may be slightly curved to form a broad arc of a circle having the pivot point of the respective bench unit as its center.

The pivoting hiking bench system can easily be adapted to mono-hull as well as multi-hull craft. When used with a tri-hull craft, the pivot point or points are affixed to the center hull. For a mono-hull craft, a single pivot point would be affixed at a point situated on the center line of the craft, and, in the case where port and starboard benches have separate pivot points, the individual pivot points would be affixed near the craft's center line. The pivoting hiking system can be adapted to a twin-hull catamaran as well, by mounting a cross-beam affixed to both hulls. The cross-beam may include a plurality of braces affixing it to the twin hulls of the catamaran, and has pivot points to which the port and starboard benches are attached near the center line of the craft.

The hiking bench preferably includes some means for preventing the sailor from moving beyond the bench's outer limits. A lip, a curved seat, or other type of end stop located at the outboard end of each bench is suitable for that purpose.

In the present invention, the usefulness of the hiking bench is increased by its capability to extend beyond the outboard edge of the craft, thereby enabling a sailor to better trim the craft at high speeds or in strong winds by hiking out well beyond the edge of the sailcraft. Both port and starboard hiking benches are held in place by some type of tension means, such as a bungee cord, and thus kept from falling off the outboard end of the bench unit.

For those types of watercraft which experience more significant heeling, it is desirable to avoid the use of permanently fixed wings that can extend far enough beyond the hull width so as to contact the water on the leeward side of the craft, thereby affecting trimming efforts. The present invention alleviates this problem by providing a parking system, consisting of a tension means that 'parks' the leeward bench unit inside the gunwale.

An important safety component of the present invention is the application of a handrail affixed to each hiking bench section. The handrail aids the sailor in moving from one position to another as he or she slides along the bench between the outer gunwale and the pivot point at the center of the craft. It also provides a secure means of connecting the sailor directly to the watercraft, especially while sailing at high speeds, in gusty winds, or in rough seas. The handrail need not extend the entire distance from the outer end of a bench section to the its pivot point; the absence of a handrail near the pivot point facilitates movement fore and aft along the center section of the craft.

Each hiking bench is linked by a coupling means to a chassis that permits easy side-to-side, i.e., port to starboard, movement of the bench thereon. Although that coupling means may be any type of component that permits the bench to move, including, but not limited to, a rail captured within a channel, a bar within a tube, etc., it is preferably a pair of rollers that capture a rectangular chassis rail.

The outboard end of each chassis is in turn linked to an outboard rail. A track-and-car system commonly used in traveler systems on small sailcraft, wherein the system uses recirculating bearings, is preferred, but any type of coupling means that permit easy movement of the chassis and hiking bench unit along the outboard rail may be used. The rails and chassis may be made of any suitable material, including, but not limited to, a non-metallic material such as fiberglass, or a metal material, such as aluminum.

An additional optional safety component of the present invention is a braking system that is easily accessed by the sailor so as to prevent undesired fore and aft movement of the hiking bench. This is particularly useful in rough seas, wherein motion of the craft may be great enough to cause fore and aft movement of the bench, or sudden deceleration of the craft when its bow is "stuffed" in a wave, that would ordinarily pitch a sailor forward uncontrollably. This braking system may be relatively simple or relatively complex as a function of the need to access it quickly. In one embodiment of the invention, the braking system may simply be a rope attached to the stern of the craft and passed through a cam cleat attached to the hiking bench unit, thereby fixing the position of the bench unit with respect to the bow or stern. Additionally, a blocking bar, such as that described in U.S. patent application No. 08/730,749, of which this application is a continuation-in-part, or a caliper brake may be used as the braking system in the present invention.

In operation, the combination of the pivoting hiking bench and the outboard rail system permits the sailor to easily and quickly reach all important areas of the craft much more safely and with much less physical exertion than is presently required. Each of the outboard rails rests on bosses attached to the noted gunwales, creating a flat surface for the roller system to travel upon. The bench coupled to the rails in the manner noted may be sized as desired. However, it is preferably only wide enough for the sailor to sit on and place one leg on either side of it. Further, it may be varied in height, but should not be so far above the trampoline or hull below that the sailor is unable to comfortably rest his or her feet on that trampoline or hull. Instead, the positioning of the bench permits the sailor to sit comfortably above the surface of the trampoline with knees bent, thus avoiding the awkward sitting position associated with the trampoline. It also provides a relatively dry seat.

The bench and chassis provide a means for the sailor, by simply by pushing on that underlying trampoline or hull surface with the feet while remaining steadily balanced and seated on the bench, to move out to either the port or starboard gunwale from the center of the craft without the need to walk on the unsteady surface below. The pivot point and outboard rail system similarly provides the sailor with the capability to move fore and aft, but, again, with balance. In that situation, the entire hiking bench unit—and the sailor along with it—pivotally moves fore and aft as the sailor moves it fore and aft along the stationary rails by pushing his or her feet on the underlying surface.

The design of the pivoting hiking bench of the present invention provides the optimum righting moment that is not available with present sail craft designs. This capability permits the sailor to shift his or her weight inboard or outboard on the hiking board while simultaneously permitting the sailor to shift his or her body weight fore and aft in order to optimize boat trim, thereby optimizing boat speed. This capability is achieved with a simultaneous reduction in the physical strain on the sailor.

U.S. patent application No. 08/730,749, of which this application is a continuation-in-part, described the use of multiple hiking benches on a sailcraft. Likewise, more than one pivoting hiking bench system—a 'system' consisting of a port hiking bench unit and a starboard hiking bench unit—of the present invention can be installed on a single sailcraft. Because the hiking bench units of the present invention pivot around a central point, however, greater spacing between pivoting bench systems is necessary to prevent interference between different pivoting bench units.

Supplemental components that may easily be incorporated into the principal components include the introduction of movable ballast coupled to the bench, a sliding seat that may have a comfortable backrest and that may be detachably affixed to the bench, and any other attachments that a sailor may deem useful in increasing the efficiency of operating the craft.

These and other advantages will become apparent upon review of the following detailed description of the invention, the accompanying drawings, and the appended claims.

DETAILED DESCRIPTION OF THE PREFERRED EMBODIMENTS OF THE INVENTION

It is to be understood that, unless otherwise specified, any description of a port hiking bench unit and the components thereof encompasses the corresponding component of the starboard hiking bench units in the present invention, and vice versa.

Figure 1B:
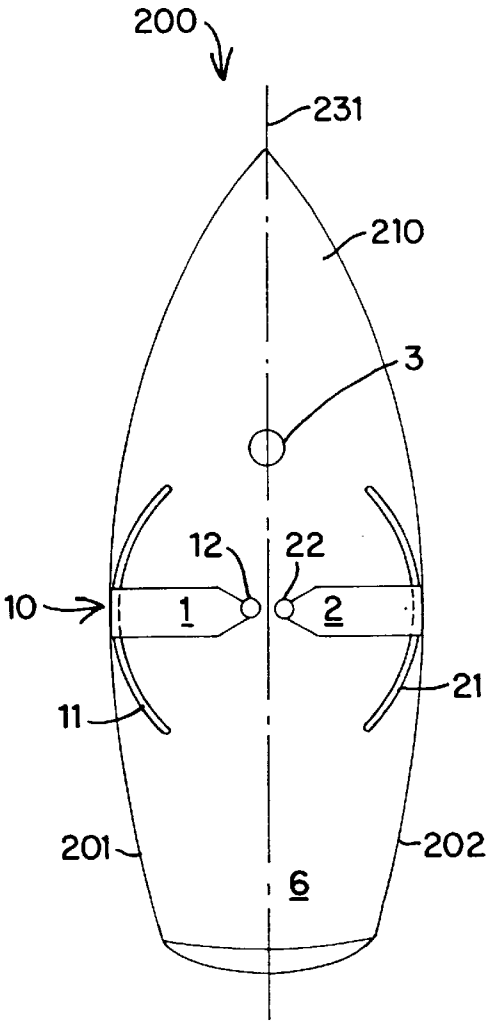
FIG. 1*b* is an overhead view of the pivoting hiking bench of the present invention coupled to a mono-hull craft.
Figure 1A:
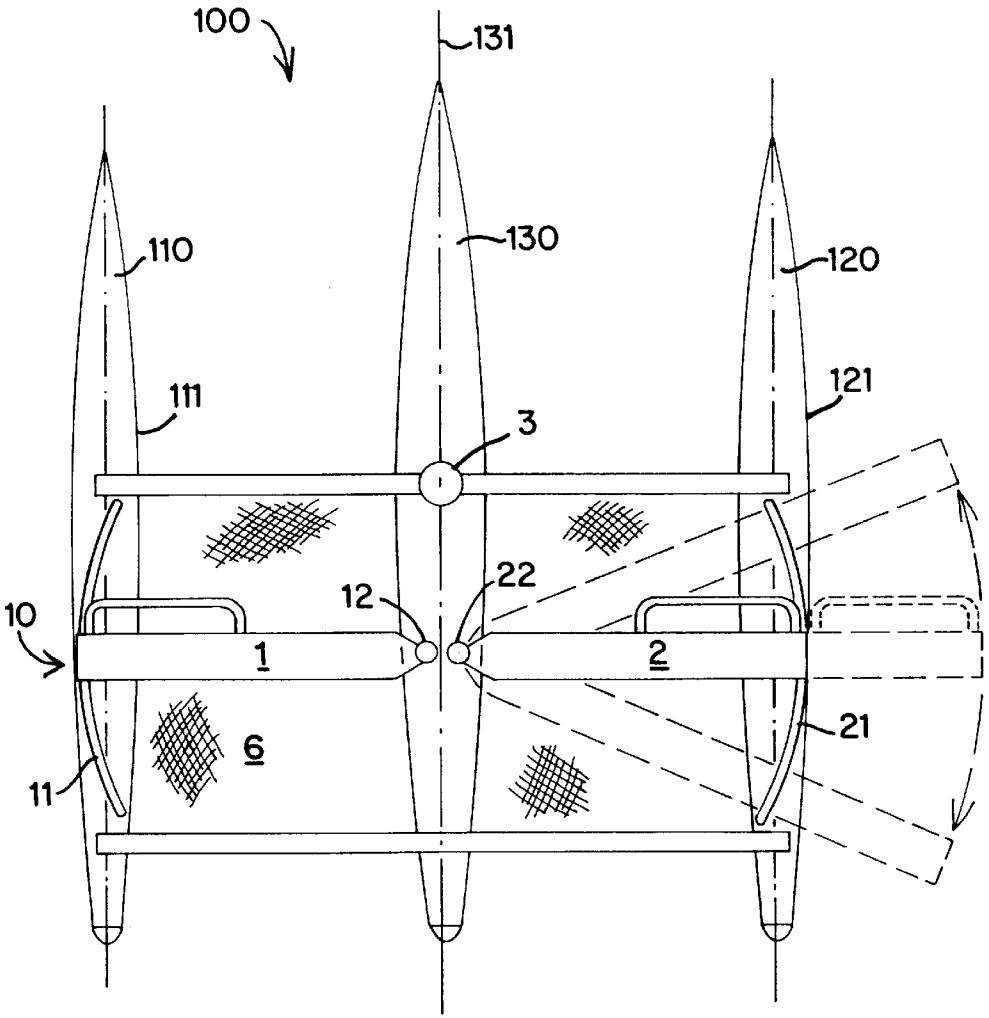
FIG. 1*a* is an overhead view of the pivoting hiking bench of the present invention coupled to a trimaran.
Figure 1D:
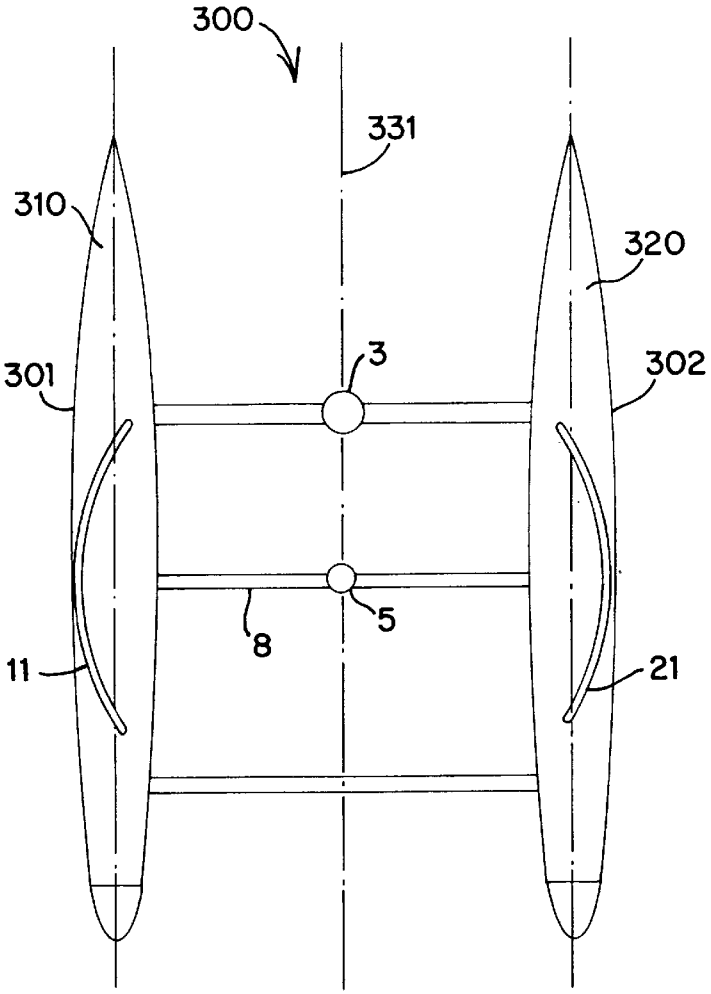
FIG. 1*d* is an overhead view of a catamaran showing the cross-beam and twin pivoting points used to couple the pivoting hiking bench of the present invention to a catamaran hull.
Figure 1C:
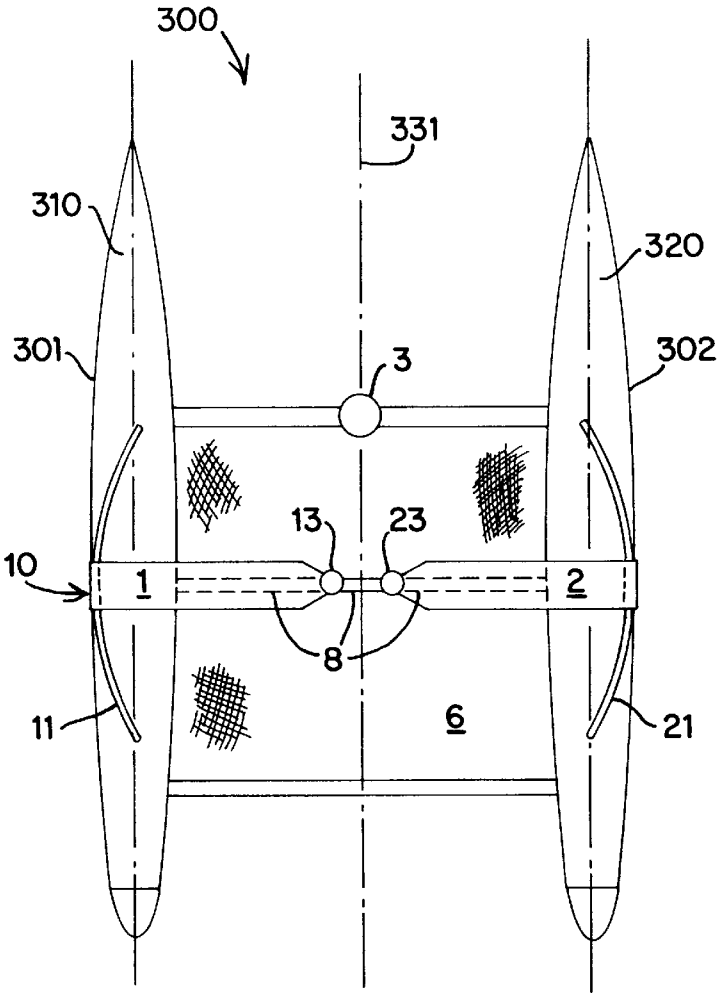
FIG. 1*c* is an overhead view of the pivoting hiking bench of the present invention coupled to a catamaran.

FIGS. 1*a*, 1*b*, and 1*c* are overhead views of the pivoting hiking bench system 10 of the present invention coupled to three types of watercraft: a trimaran 100 (FIG. 1*a*); a mono-hull craft 200 (FIG. 1*b*); and a catamaran 300 (FIG. 1*c*). The Preferred Embodiment will be described with respect to a trimaran (FIG. 1*a*). The system 10 shown in FIG. 1*a* is coupled to a trimaran sailboat 100 and includes as its principal components a port hiking bench unit 1 and a starboard hiking bench unit 2. The port bench unit 1 is coupled to a port outboard rail 11 by movable coupling means and to a port pivot 12. Similarly, the starboard bench unit 2 is coupled to a starboard outboard rail 21 by movable coupling means and to a starboard pivot 22. Both port pivot 12 and starboard pivot 22 are affixed to the center-hull 130 of the trimaran 100. The port pivot 12 and starboard pivot 22 may be coupled to the center-hull 130 at different pivot points, located port and starboard, respectively, of the center-line 131 of the center-hull 130. Alternately, the port pivot 12 and starboard pivot 22 may be coupled to the center-hull 130 at a single pivot point located along the center-line 131 of the center-hull 130.

Figure 2:
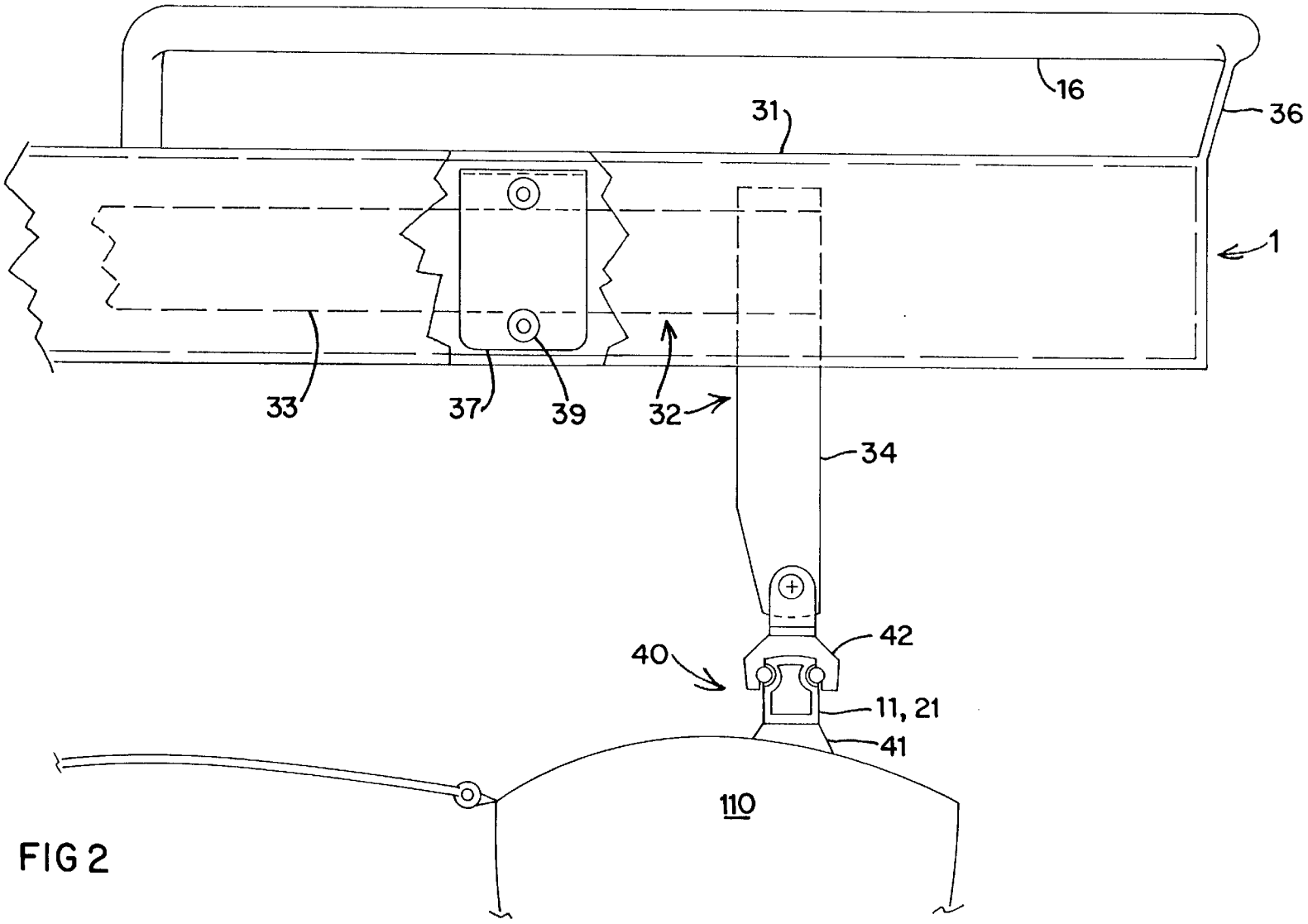
FIG. 2 is a cross-sectional view of the outboard end a bench unit, showing the hiking bench, handrail, optional end-stop, chassis rail and outboard end-frame, chassis roller means, coupling of the chassis and hiking bench to the outboard rail, the roller means for movement fore and aft along the outboard rail, and the attachment of the outboard rail to the hull of the craft.

FIG. 2 is a front view of an outboard end of the port hiking bench unit 1 and starboard hiking bench unit 2. Both port hiking bench unit 1 and starboard hiking bench unit 2 include a hiking bench 31 and a chassis 32 having at least one fixed chassis-rail 33 that connects an outboard end-frame 34 and an inboard end-frame 35, shown in FIG. 3. In the Preferred Embodiment, each chassis 31 has a pair of rectangular chassis-rails 33 affixed to the inboard and outboard end-frames 35, 34. A bracket 37 having roller means 38, shown in FIG. 2, is securedly affixed to the underside of the hiking bench 31 and couples the port hiking bench 31 to a chassis-rail 33. In the Preferred Embodiment, two brackets 37 having roller means 38 couple the hiking bench 31 to two chassis-rails 33.

Figures 3, 4:
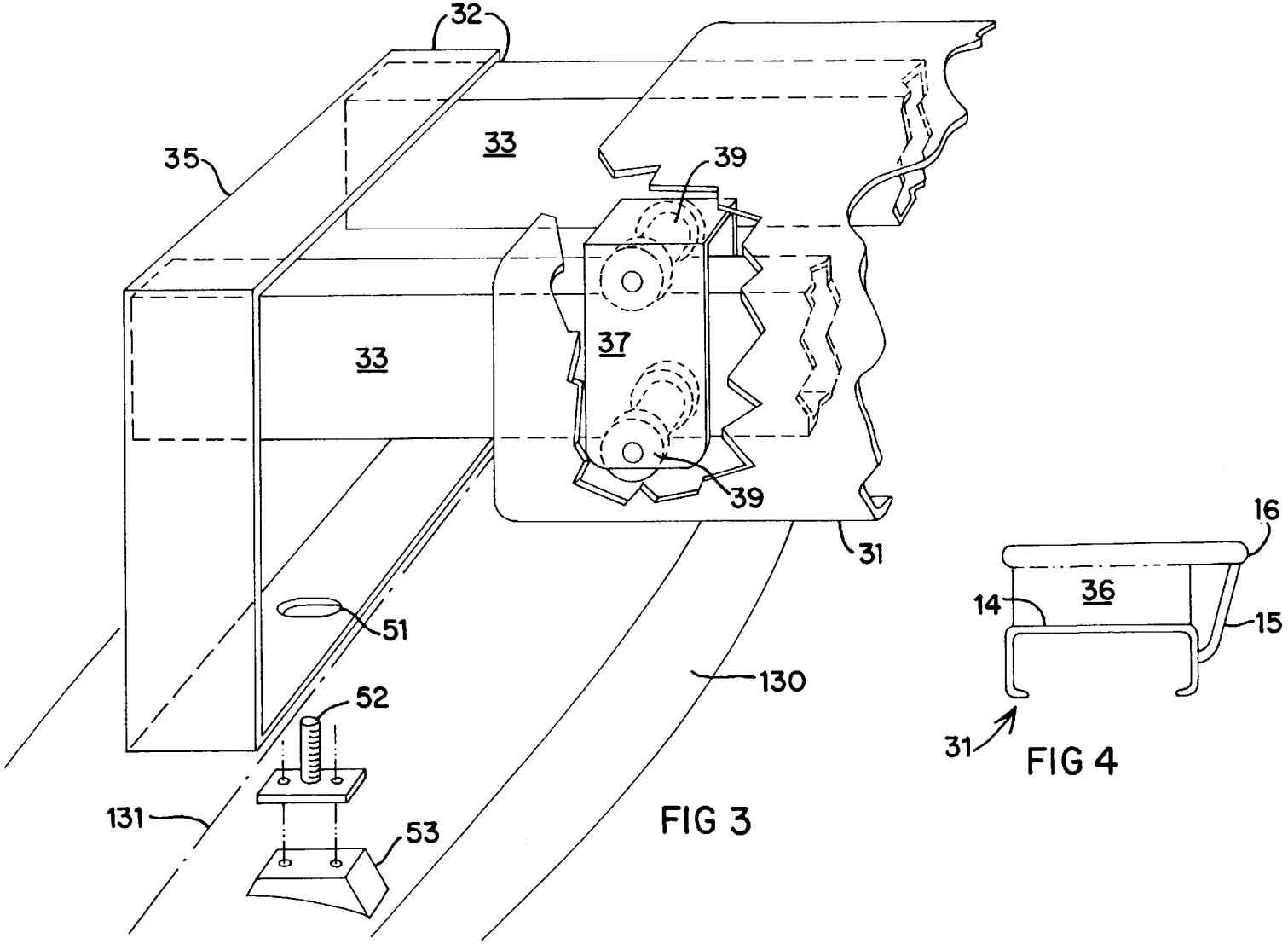
FIG. 3 is a perspective view of the inboard end of a pivoting hiking bench unit of the present invention, showing the pivot point, chassis rail and inboard end-frame, hiking bench, and chassis roller means.
FIG. 4 is a cross-sectional view of the hiking bench seat of the present invention, showing the optional security handrail coupled thereto.

As illustrated in FIG. 4, the hiking bench 31 includes a seat 14 and a handrail 16 that a sailor 99 may use for balance as he or she slidingly moves along either the port hiking bench unit 1 or starboard hiking bench unit 2. The handrail 16 also provides a direct connection of the sailor 99 to the watercraft. This is of particular importance at high sailing speeds, in rough seas, or gusty wind conditions. The handrail 16 is coupled to the port hiking bench seat 14 by means of a set of coupling bars 15 that may be fabricated of a material similar to that used to make the handrail 16. In the Preferred Embodiment, handrails 18 extend only half the length from the outward end of the port hiking bench unit 1 and starboard hiking bench unit 2, respectively. The absence of handrails 16 along the inner half of the port hiking bench unit 1 and starboard hiking bench unit 2 makes movement fore and aft along the center portion of the sail craft easier than if the handrails 16 extended the entire length of the port hiking bench unit 1 and starboard hiking bench unit 2. The outboard end of each hiking bench seat 14 may optionally have an upturned lip, a handle, or a rail to enhance the security of the pivoting hiking bench system 10 by acting as a bench end stop 36. The upturned or curved lip can act as a signal to the sailor 99 that he or she has reached the end of the hiking bench seat 14. It can also stop the sailor 99 from falling from the port hiking bench unit 1 and starboard hiking bench unit 2 in the event of any sudden shift of the sailcraft.

At the outboard end of the port hiking bench unit 1 and starboard hiking bench unit 2, the outboard end-frame 34 of the chassis 32 is coupled to the outboard rail 11, 21 by a rolling means 40, as shown in FIG. 2. In the Preferred Embodiment, the rolling means 40 is a track-and-car system 42 using recirculating bearings. This system is identical to traveler systems commonly used in small sailcraft. The car 42 is linked to the outboard end-frame 34 of the port hiking bench unit 1 and starboard hiking bench unit 2, and the port outboard rail 11 and starboard outboard rail 21 form the tracks upon which the respective hiking bench units move. The port outboard rail 11 and starboard outboard rail 21 or track are attached to the port hull 110 and starboard hull 120 of the craft by a track bosses 41 so as to provide the car 42 with a flat surface upon which to run. The port outboard rail 11 may be curved to form an arc of a circle having the port pivot 12 as its center and the starboard outboard rail 21 correspondingly curved to form an arc of a circle having the starboard pivot 22 as its center. Although it is possible to have the port outboard rail 11 and starboard outboard rail 21 extend substantially the entire length of the craft 100, it is preferable to have them extend only a portion of that length—approximately to the sailcraft's mast 3. That portion must be sufficient to permit the sailor 99 to reach those areas of the craft necessary for its control. In operation, the coupling of the port outboard rail 11 and starboard outboard rail 21 to a hiking bench seat 14 permits the sailor to push the system 10 fore and aft as he or she pushes his or her feet on the underlying substrate 6, regardless of whether it is a hull or a trampoline.

As illustrated in FIG. 3, the inboard end-frame 35 of the chassis 32 has a pivot-hole 51 in its bottom face. A pivot pin 52 mounted to the deck or a beam section 53 near the center-line 131 of the craft. The pivot pin 52 is inserted through the pivot hole 51 and secured, preferably with a nut or cotter pin.

Figure 5A:
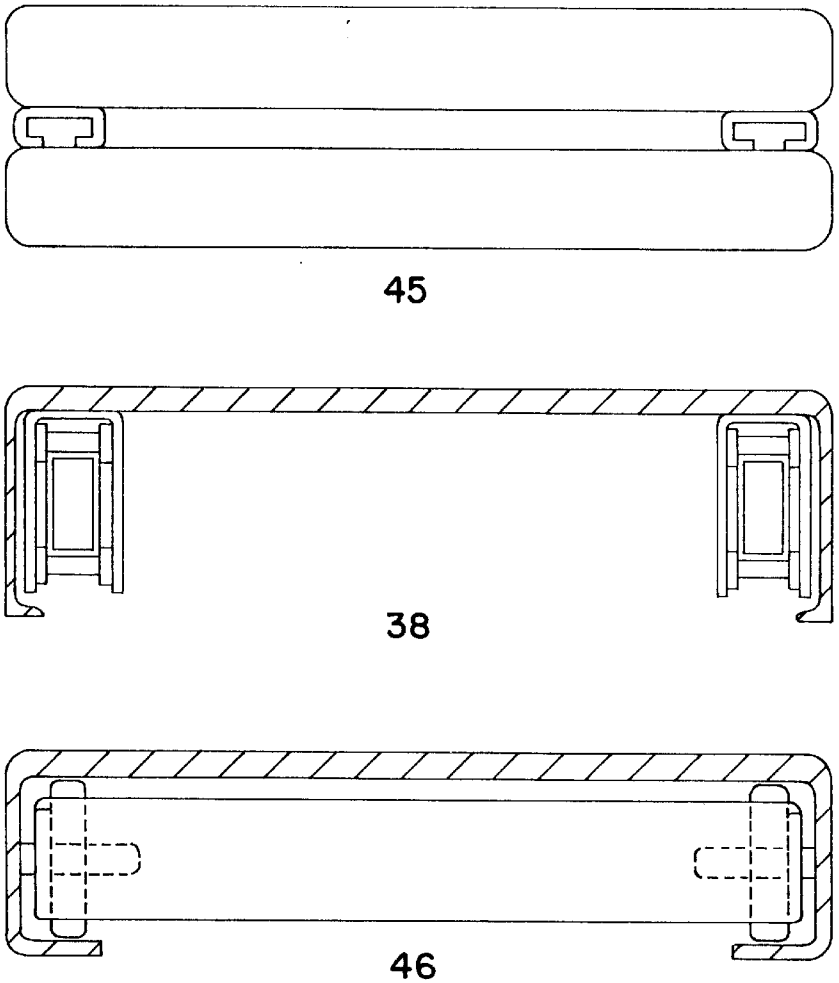
FIG. 5*a* is a cross-sectional view of tee-track, bracket rollers, and bench roller that may be employed as chassis roller means in the present invention.
Figure 5:
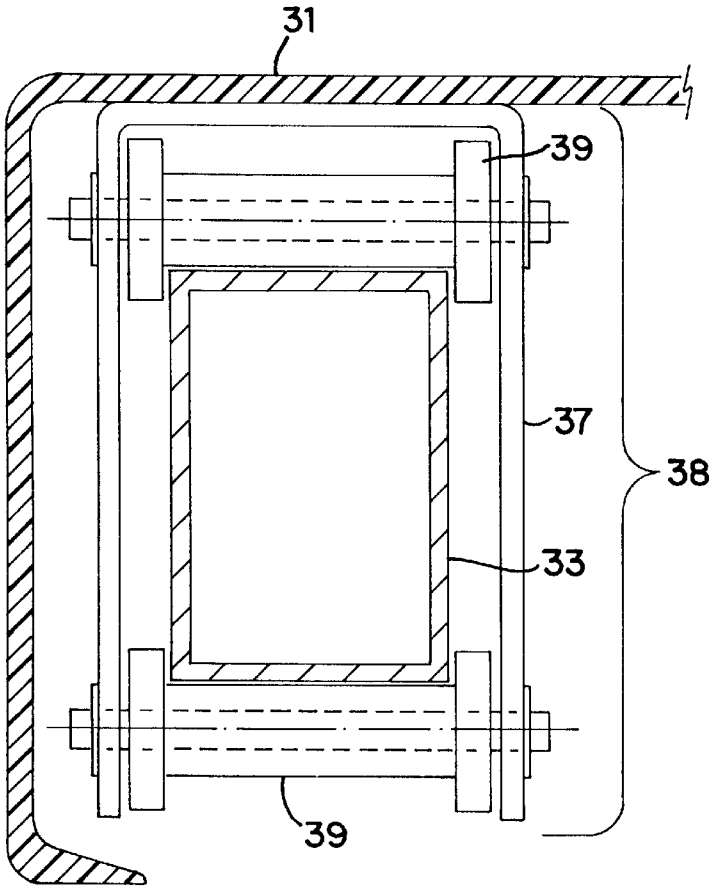
FIG. 5 is a cross-sectional view of the chassis roller means of the Preferred Embodiment.

The preferred roller means 38 for coupling the hiking bench 31 to the chassis-rails 33 are shown in FIG. 5. Two brackets 37 are securedly affixed to the underside of a hiking bench 31. A pair of rollers 39 is housed within each bracket 37. A rectangular chassis-rail 33 is captured within each bracket 37 such that one roller 39 contacts the top surface of the chassis-rail 33 and the other roller 39 contacts the bottom surface of the chassis-rail 33. With each chassis-rail 33 thus captured between a pair of rollers 39, the hiking bench 31 moves freely port and starboard. In operation, the coupling of the hiking bench seat 14 to the chassis by rollers 39 permits the sailor 99 to push the system 10 port and starboard as he or she pushes his or her feet on the underlying substrate 6, regardless of whether it is a hull or a trampoline.

The port hiking bench unit 1 and starboard hiking bench unit 2 may be fabricated of any material suitable for the intended purpose, including, but not limited to, wood, fiberglass or other non-metallic material, or a relatively lightweight metal such as Aluminum. The port hiking bench unit 1 and starboard hiking bench unit 2 may be formed with some curvature, so as to conform, to an extent, to the contour of the underlying surface. However, curvature is not necessary.

As illustrated in FIG. 1*b,* the hiking bench system 10 of the present invention is readily adaptable to other types of sailing craft, including, but not limited to a mono-hull sailboat 200. The pivoting hiking bench system 10 is adapted to such craft in essentially the same way as it is for the trimaran 100. That is, the port outboard rail 11 and the starboard outboard rail 12 are each affixed to the port gunwale 201 and the starboard gunwale 202, respectively, of the particular watercraft. When port and seaboard bench units do not share a common pivot point, the port pivot 12 and starboard pivot 22 are located on their respective sides and close to the center line 231 of the mono-hull 210. If, on the other hand, the port hiking bench unit 1 and starboard hiking bench unit 2 share a common pivot point, the port pivot 1 and starboard pivot 22 are located at a single point lying on the center line 231 of the mono-hull 210.

The pivoting hiking bench system 10 can also be mounted on a catamaran 300 as shown in FIG. 1*c,* using a cross-beam 8. The cross-beam 8 includes a port pivot point 12 and a starboard pivot point 22, or a single pivot point 5, which is shown in FIG. 1*d.* As illustrated in FIG. 1*a,* the cross-beam is mounted on the port hull 310 and starboard hull 320 of a catamaran 300. The port pivot 12 and starboard pivot 22 are coupled to a port pivot point 13 and starboard pivot point 23, respectively, located on the cross-beam 8 along either side of the center-line 331 of the catamaran 300. Alternately, the port hiking bench unit 1 and starboard hiking bench unit 2 can share a single pivot point 5 located on the cross-beam 8 at a point on the center-line 331 of the craft. Aside from the use of the cross-beam 8 and possible single pivot point 5, the pivoting hiking bench system 10 is mounted on a catamaran 300 in essentially the same way as it is for the trimaran 100. That is, the port outboard rail 11 and the starboard outboard rail 21 are each affixed to the port gunwale 301 and the starboard gunwale 302, respectively, of the catamaran 300.

In order to maximize the effect of hiking out, a sailor must be able to hike out beyond the gunwale of the craft. To accomplish this, the port hiking bench unit 1 and starboard hiking bench unit 2 are extendable. Extension is achieved by rolling the hiking bench 31 outward along the chassis-rails 33. Aside from the rolling means 38 of the Preferred Embodiment, other rolling systems, such as a tee-track slider 45 or a bench roller system 46, shown along with the rolling means 38 in FIG. 5*a,* may be used for extension of the hiking bench 31.

Figure 6:
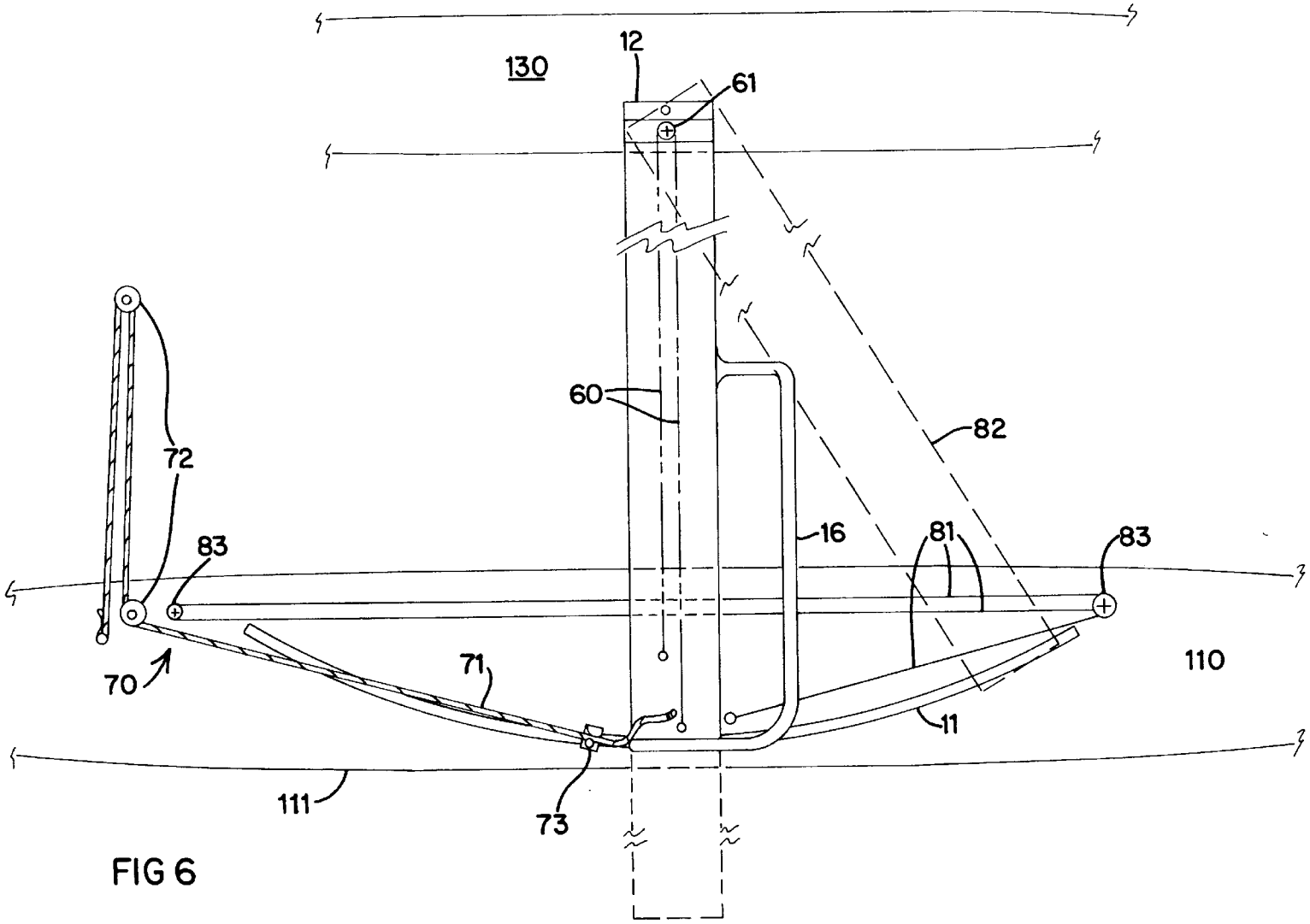
FIG. 6 is an overhead view of a port hiking bench unit of the present invention, showing control lines.
Figure 7:
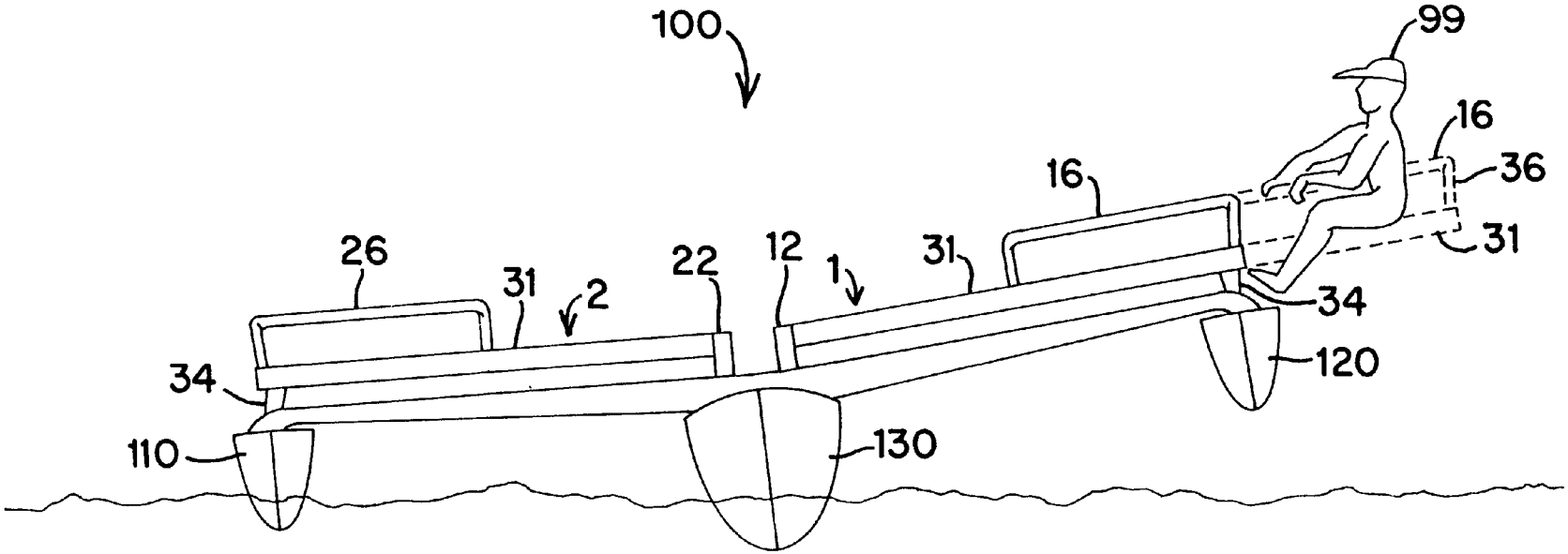
FIG. 7 is a perspective view of the present invention affixed to a trimaran, showing the port hiking bench in the extended position and a sailor seated thereon.

FIG. 7 shows a hiking bench 31 in the extended position. The outboard end-frame 34 of the chassis 32 prevents the hiking bench 31 from rolling off the end of either the port hiking bench unit 1 or starboard hiking bench unit 2, as the brackets 37 affixed to the hiking bench 31 cannot move outboard beyond the chassis end-frame 34. Handrails 16 provide a secure hand hold for the person 99 hiking out. A tensioning means 60, preferably a bungee cord, illustrated in FIG. 6, also holds the hiking bench 31 in. One end of the tensioning means 60 is attached to the chassis outboard end-frame 34, while the other end is run through a pulley 61 located on the inboard end-frame of the chassis 32 and attached to the hiking bench 31. A sailor 99 hikes out over the side of the craft by pushing against the resistance of the tensioning means 60 and rolling the hiking bench 31 out. The tensioning means also acts to prevent the sailor 99 and hiking bench 31 from falling overboard. When the hiking bench unit 31 is not in use, the tensioning means 60 parks the bench 31 such that it does not protrude beyond the port gunwale 111 or starboard gunwale 121.

An optional safety feature shown in FIG. 6 is a braking system 70 that aids the sailor 99 in controlling the fore and aft movement of the port hiking bench unit 1 and starboard hiking bench unit 2. In the Preferred Embodiment, a braking line 71 is secured at one end to the craft astern of the port hiking bench unit 1 while the other end is led through a pair of pulleys 72 that act as a tensioner for the braking line 71 and run through a cam-cleat 73 attached to the port hiking bench unit 1. To fix the fore/aft position of the port hiking bench unit 1, the sailor simply secures the braking line 71 in the jaws of the cam-cleat 73. The fore-and-aft movement of the starboard hiking bench unit 2 is controlled by a mechanism identical to that described above for the port hiking bench unit 1.

Another optional feature of the Preferred Embodiment is the tension system used to park a bench unit when it is not in use. Without some means of retracting the port hiking bench unit 1 and starboard hiking bench unit 2, the hiking bench unit on the leeward side of the craft may inadvertently pivotally extend outward into the water during heeling, thereby adversely affecting speed and trim. It is also desirable to prevent the hiking bench units from swinging outward during transport or storage and causing damage to any nearby objects or people. The tension system used in the Preferred Embodiment to park the hiking bench unit is shown in FIG. 6. Tensioning means 81, preferably a pair of bungee cords, are attached to the craft forward of the port outboard rail, 11 and starboard outboard rail 21. The tensioning means 81 are run through a series of pulleys 83 located on the port hull 110 and starboard hull 120 of the craft and attached to the forward ends of the port hiking bench unit 1 and starboard hiking bench unit 2. When either port hiking bench unit 1 or starboard hiking bench unit 2 is not in use, the tensioning means 81 pulls or "parks" the port hiking bench unit 1 or starboard hiking bench unit 2 to forward position 82 such that it does not protrude beyond the port gunwale 111 or starboard gunwale 121, respectively. Combined with the braking system 70 previously described, the parking system also prevents sudden or abrupt movement of the port hiking bench unit 1 and starboard hiking bench unit 2 fore or aft.

Although the present invention has been described with specific reference to the detailed features of the Preferred Embodiment, it is to be understood that alternative embodiments and equivalents are within the scope of the invention as defined by the appended claims.

I claim:

1. A device to aid in moving about a watercraft, said device comprising:

a. at least one bench unit, said bench unit being pivotally coupled to said watercraft; and b. at least one outboard rail, said outboard rail being affixed to a gunwale of said watercraft;

wherein said bench unit is movably coupled to said rail such that said bench unit may be pivotally moved fore and aft on said watercraft independently of another said bench unit.

2. The device as claimed in claim 1 wherein said bench unit further comprises a hiking bench and a chassis.

3. The device as claimed in claim 2 wherein said hiking bench includes a bench seat and a bottom surface and said chassis is rollingly coupled to said bottom surface of said hiking bench by a first rolling means.

4. The device as claimed in claim 3 wherein said hiking bench is rollingly extendable outboard beyond an outboard end of said bench unit.

5. The device as claimed in claim 3 wherein said bench unit includes one or more handrails coupled to said bench seat.

6. The device as claimed in claim 2 wherein said chassis is rollingly coupled to said outboard rail by a second rolling means.

7. The device as claimed in claim 1 wherein said outboard rail each extend in length approximately from a rear of said watercraft to a mast of said watercraft.

8. The device as claimed in claim 1 further comprising a braking system for halting and permitting movement fore and aft of said bench unit on said outboard rail.

9. The device as claimed in claim 8 wherein said braking system includes a brake-line, wherein said brake-line is affixed to said watercraft and releasably coupled to said bench unit by a brake-line coupling means, such that said bench unit is freely movable fore and aft when said brake-line is uncoupled from said bench unit.

10. The device of claim 1 wherein said watercraft is a trimaran.

11. The device of claim 1 wherein said watercraft is a mono-hull sailcraft.

12. The device of claim 1 wherein said watercraft is a catamaran.

13. The device as claimed in claim 12 wherein said device further comprises at least one pivot point, said pivot point being mountably affixed to a port hull of said catamaran by at least one port brace and mountably affixed to a starboard hull of said catamaran by at least one starboard brace, and located on a center-line longitudinally bisecting said catamaran.

14. The device as claimed in claim 1 wherein said device includes a port bench unit, a starboard bench unit, a port outboard rail, and a starboard outboard rail.

15. The device of claim 14 wherein said port bench unit is movably coupled to a port pivot point on said watercraft and said starboard bench unit is movably coupled to a starboard pivot point on said watercraft.

16. The device of claim 15 wherein said port bench unit and said starboard bench unit are movably coupled to a single pivot point on said watercraft.

17. A device to aid in moving about a watercraft comprising:

a. a port bench unit pivotally coupled to said watercraft;

b. a starboard bench unit pivotally coupled to said watercraft;

c. a port outboard rail affixed to a port gunwale of said watercraft, wherein said port bench unit is movably coupled to said port outboard rail by a port rail rolling means; and d. a starboard outboard rail affixed to a starboard gunwale of said watercraft, wherein said starboard bench unit is movably coupled to said starboard outboard rail by a starboard rail rolling means;

whereby said port bench unit may be pivotally moved fore and aft on said watercraft independently of said starboard bench unit, and said starboard bench unit may be pivotally moved fore and aft on said watercraft independent of the movement of said port bench unit.

18. The device as claimed in claim 17 wherein each of said port bench unit and said starboard bench unit further comprises a hiking bench and a chassis.

19. The device as claimed in claim 18 wherein said hiking bench further comprises a seat and a bottom surface, said bottom surface being rollingly coupled to said chassis by a chassis rolling means.

20. The device as claimed in claim 17 wherein said chassis further comprises an inboard end-frame, said inboard end-frame having a through-hole capable of receiving a pivoting means, an outboard end-frame, and at least one rectangular chassis-rail having an inboard end affixed to said inboard end-frame and an outboard end affixed to said outboard end-frame.

21. The device as claimed in claim 20 wherein said chassis rolling means comprises at least one bracket, said bracket having a top, a first side, and a second side, and at least one pair of rollers rollingly coupled to said first side and said second side of said bracket, wherein said top of said bracket is affixed to said bottom surface of said hiking bench, and said chassis-rail is rollingly captured between said pair of rollers and said first side and said second side of said port bracket.

22. The device of claim 20 wherein said port rail rolling means further comprises a car pivotally coupled to said outboard end-frame of said chassis of said port bench unit, said car having recirculating bearings and being rollingly coupled to said port outboard rail, and wherein said starboard rail rolling means further comprises a car pivotally coupled to said outboard end-frame of said chassis of said port bench unit; said car having recirculating bearings and being rollingly coupled to said starboard outboard rail.

23. The device as claimed in claim 18 wherein said hiking bench of said port bench unit is rollingly extendable outboard beyond an outboard end of said port bench unit and said hiking bench of said starboard bench unit is rollingly extendable outboard beyond an outboard end of said starboard bench unit.

24. The device as claimed in claim 19 wherein said hiking bench further includes at least one handrail; said handrail being coupled to said bench unit.

25. The device as claimed in claim 17 further comprising a braking system for halting and permitting pivotal movement fore and aft of each of said port bench unit and said starboard bench unit.

26. The device as claimed in claim 25 wherein said braking system includes a port brake-line and a starboard brake-line, wherein said port brake-line is affixed to said watercraft and releasably coupled to said port bench unit by a port coupling means and said starboard brake-line is affixed to said watercraft and releasably coupled to said starboard bench unit by a starboard coupling means, such that said port bench unit is freely movable fore and aft when said port brake-line is uncoupled from said port bench unit and said starboard bench unit is freely movable fore and aft when said starboard brake-line is uncoupled from said starboard bench unit.

27. The device as claimed in claim 26 wherein both said port coupling means and said starboard coupling means are cam cleats.

28. The device as claimed in claim 17 further comprising a parking system for pivotally returning said port bench unit to a position inboard of said port gunwale and said starboard bench unit to a position inboard of said starboard gunwale.

29. The device as claimed in claim 28 wherein said parking system includes a port tensioning means and a starboard tensioning means, wherein said port tensioning means is affixed to said watercraft and coupled to said port bench unit and said starboard tensioning means is affixed to said watercraft and coupled to said starboard bench unit, such that said port bench unit is pivotally drawn inboard of the port gunwale by said port tensioning means when said port bench unit is not in use and said starboard bench unit is pivotally drawn inboard of the starboard gunwale by said starboard tensioning means when said starboard bench unit is not in use.

30. The device of claim 17 wherein said watercraft is a trimaran.

31. The device of claim 17 wherein said watercraft is a mono-hull craft.

32. The device of claim 17 wherein said watercraft is a catamaran.

* * * * *